US007661656B1

(12) United States Patent
Gibbs et al.

(10) Patent No.: US 7,661,656 B1
(45) Date of Patent: Feb. 16, 2010

(54) BARBED TAPE

(76) Inventors: Edward L. Gibbs, 1555 N. Mingo Rd., Tulsa, OK (US) 74116; David F. Sheehan, 1200 E. Cole, Moundridge, KS (US) 67107; Benjamin C. Bigham, 1200 E. Cole, Moundridge, KS (US) 67107

( * ) Notice: Subject to any disclaimer, the term of this patent is extended or adjusted under 35 U.S.C. 154(b) by 0 days.

(21) Appl. No.: 12/016,902

(22) Filed: Jan. 18, 2008

Related U.S. Application Data

(60) Provisional application No. 60/887,263, filed on Jan. 30, 2007.

(51) Int. Cl.
*E04H 17/04* (2006.01)
*B21F 25/00* (2006.01)

(52) U.S. Cl. ..... 256/6

(58) Field of Classification Search ..... 256/2–9
See application file for complete search history.

(56) References Cited

U.S. PATENT DOCUMENTS 466,744 A * 1/1892 Allis ..... 256/8
466,746 A * 1/1892 Allis ..... 256/8
D35,341 S * 11/1901 Smith ..... D25/46
2,541,388 A 2/1951 Swanson
2,908,132 A 10/1959 Klemm
2,908,484 A 10/1959 Uhl
2,940,732 A 6/1960 MacChesney et al.
2,973,185 A * 2/1961 Brixner ..... 256/6
3,010,701 A 11/1961 Klemm
3,224,736 A 12/1965 Musgrave
3,455,539 A 7/1969 Loofbourrow
3,463,455 A * 8/1969 Meckel ..... 256/8
3,480,256 A 11/1969 Simon et al.
3,550,911 A * 12/1970 Burton ..... 256/7
3,640,507 A * 2/1972 Volbach et al. ..... 256/6
3,763,529 A 10/1973 Musgrave
3,916,958 A 11/1975 Uhl
3,990,485 A 11/1976 Uhl
4,028,925 A * 6/1977 Mainiero ..... 72/294
4,040,603 A * 8/1977 Mainiero ..... 256/8
RE30,814 E 12/1981 Mainiero
4,328,955 A 5/1982 Hermans
4,484,729 A 11/1984 Mainiero et al.
4,503,423 A 3/1985 Mainiero et al.
4,509,726 A 4/1985 Boggs et al.
4,525,701 A 6/1985 Leih
4,571,578 A 2/1986 Karas
4,666,129 A 5/1987 Dobson
4,718,641 A 1/1988 Mainiero
4,784,373 A 11/1988 Mainiero
4,818,972 A 4/1989 Mainiero et al.
4,833,904 A 5/1989 Mainiero
4,844,422 A 7/1989 Major (Continued)

*Primary Examiner*—Michael P. Ferguson
*Assistant Examiner*—Joshua T Kennedy
(74) *Attorney, Agent, or Firm*—Gary Peterson

(57) ABSTRACT

A barbed tape is formed from an elongate strip having laterally spaced first side and second sides. A series of sharpened barb clusters project from at least one side, and preferably both sides, of the strip. The area of the strip between each adjacent pair of barb clusters is characterized by a plurality of transverse corrugations formed adjacent the first side of the strip, and preferably extending about to the strip centerline. A continuous longitudinally extended strengthening rib may be formed on the uncorrugated second side of the strip.

8 Claims, 4 Drawing Sheets

U.S. PATENT DOCUMENTS 4,884,425 A 12/1989 Mainiero
4,887,796 A 12/1989 Cano et al.
4,906,975 A 3/1990 Casella et al.
4,915,359 A 4/1990 Cochrane
4,920,331 A 4/1990 Ver Loren van Thermaat et al.
4,920,775 A 5/1990 Mainiero
4,978,943 A * 12/1990 Mainiero et al. ..... 340/566
5,062,612 A 11/1991 Mincher
5,072,980 A 12/1991 Mainiero
5,074,529 A * 12/1991 Mainiero et al. ..... 256/8
5,109,583 A 5/1992 Pavlov
5,139,234 A 8/1992 Cochrane
D336,427 S 6/1993 Mainiero
5,401,002 A * 3/1995 Major ..... 256/2
5,530,430 A 6/1996 Pavlov
D429,342 S 8/2000 Binns
6,601,830 B1 * 8/2003 Pavlov ..... 256/8
6,926,262 B1 * 8/2005 Pavlov ..... 256/8
7,325,787 B1 2/2008 Gibbs
2006/0022184 A1 2/2006 Pavlov
2006/0214148 A1 9/2006 Major et al.

* cited by examiner

BARBED TAPE

SUMMARY OF THE INVENTION

The present invention comprises a barbed tape formed from an elongate strip having laterally spaced first side and second sides. A series of sharpened barb clusters project from at least one side of the strip. The area of the strip between each adjacent pair of barb clusters is characterized by a plurality of transverse corrugations formed adjacent the first side of the strip.

BRIEF DESCRIPTION OF THE DRAWINGS

FIG. 5 is a perspective view of a helical coil of the barbed tape of the present invention.

DETAILED DESCRIPTION OF THE INVENTION

Figure 1:
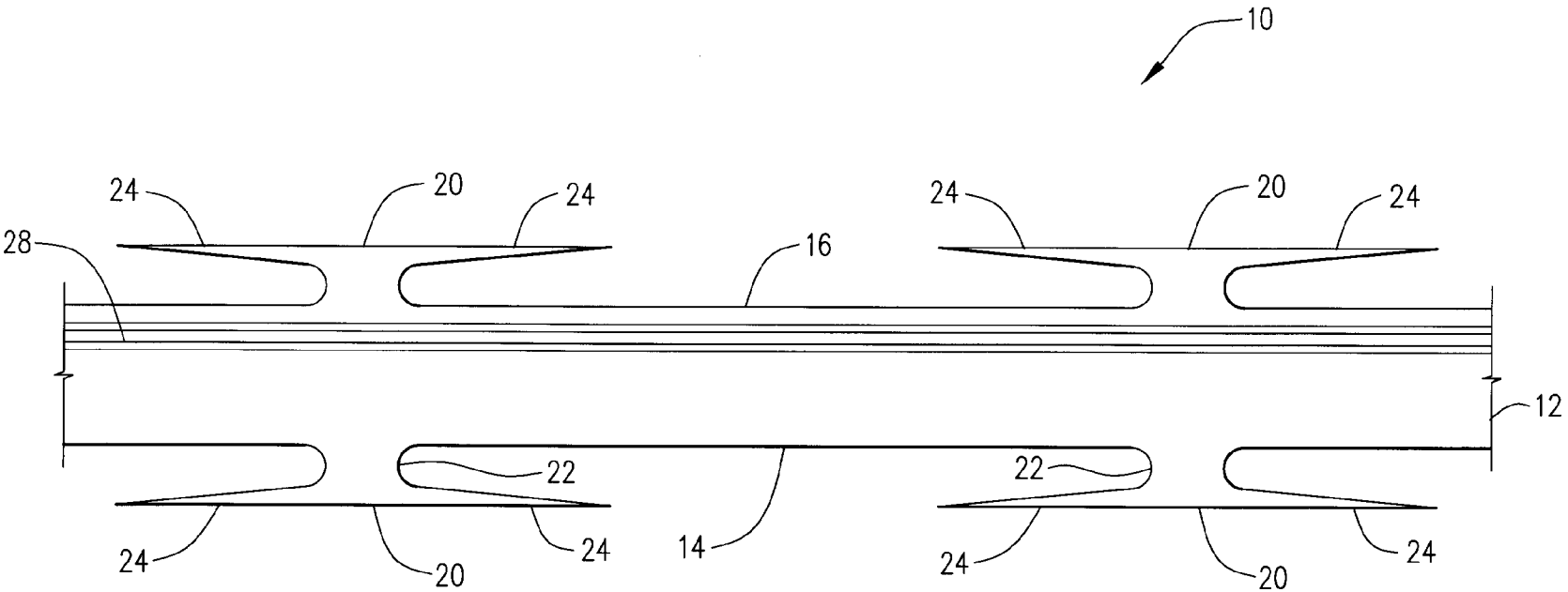
FIG. 1 is a front elevational view of the barbed tape of the present invention during the manufacturing process, after the step immediately prior to corrugation.

The barbed tape of the present invention, generally designated by reference numeral 10, is formed from a strong, durable and flexible material, such as a sheet of hardened type 301 austenitic stainless steel, preferably having a thickness of 0.035 inches. The barbed tape 10 is formed as an elongate strip 12 of generally rectangular size, having a first side 14 and an opposed second side 16. Preferably, the tape 10 is characterized by a slightly crowned side-to-side profile.

Figure 4:
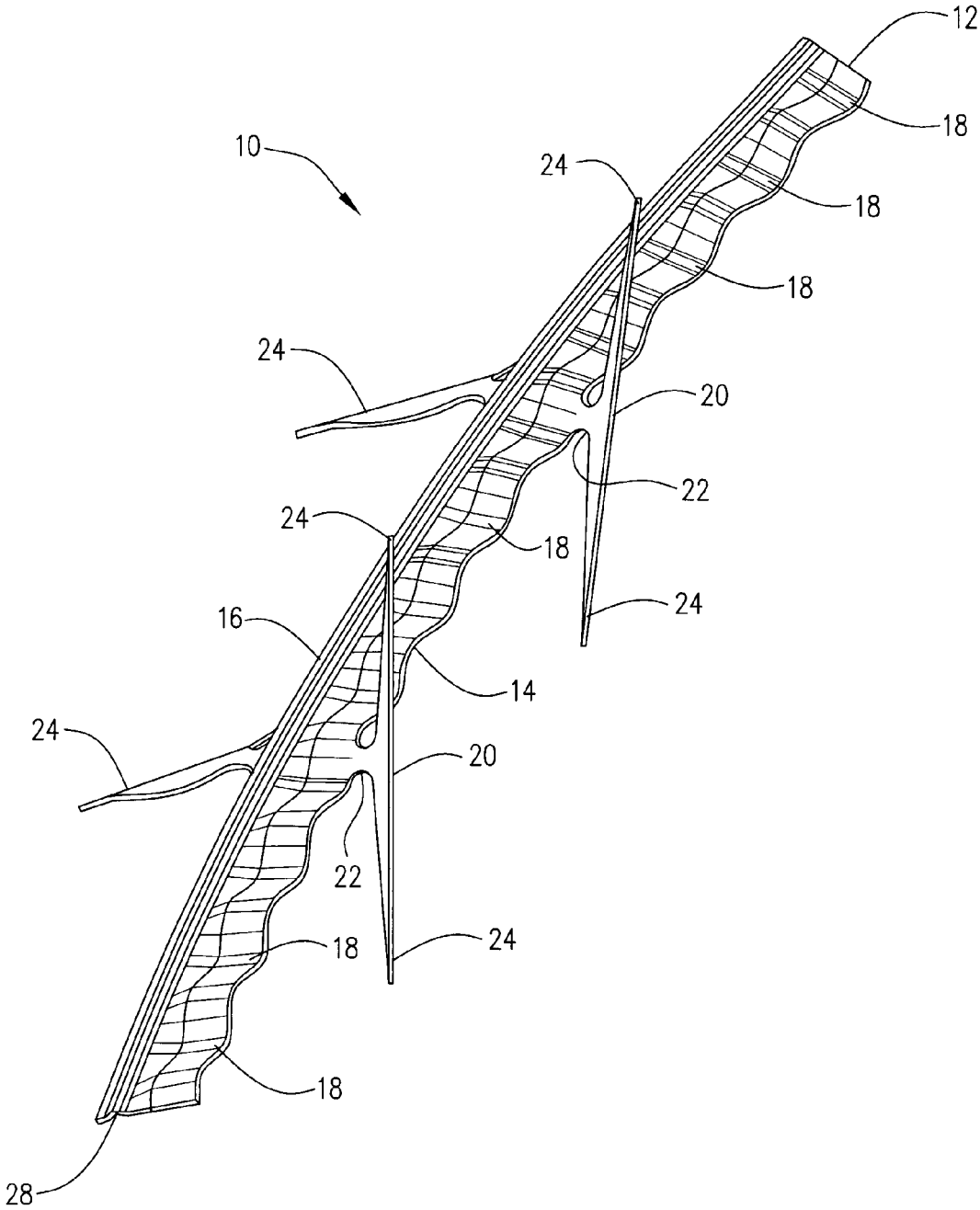
FIG. 4 is a perspective view of a section of the barbed tape of the present invention.
Figure 3:
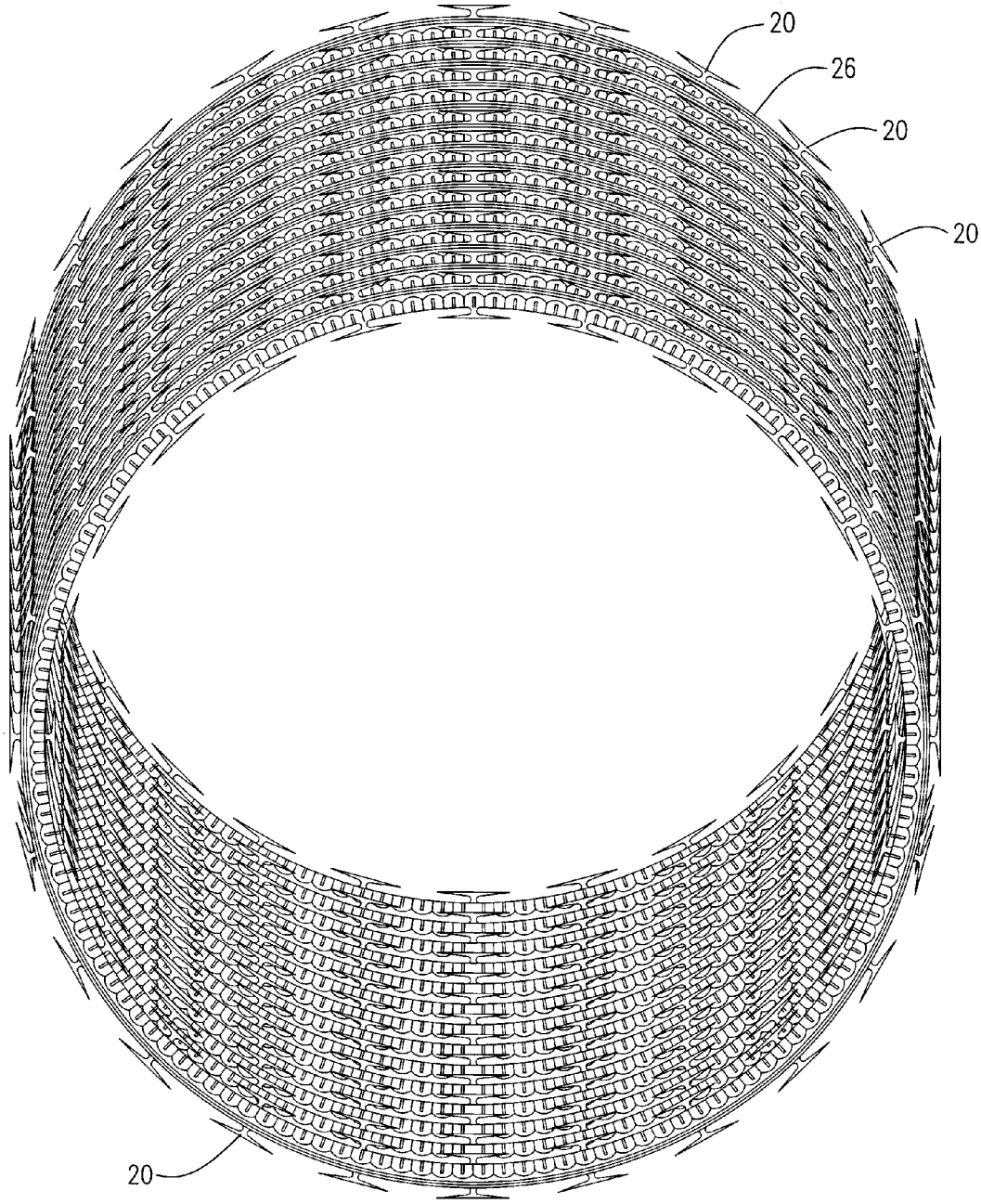

A plurality of closely spaced indentation or corrugations 18 are formed in the strip 12, on the same surface thereof. Each corrugation 18 preferably extends along a rectilinear path, and begins from a position immediately adjacent to, and preferably in contact with, the first side 14 of the strip 12, and terminates prior to reaching the second side 16. Preferably, each corrugation terminates either at or near the longitudinal centerline of strip 12. As best shown in FIG. 4, the closely spaced corrugations 18 give the barbed tape 10 an appearance similar to the edge of a pie crust. Preferably, a continuous longitudinally extending strengthening rib 28 is formed adjacent the second side 16 of the strip 12, in the uncorrugated region of the strip 12.

Figure 2:
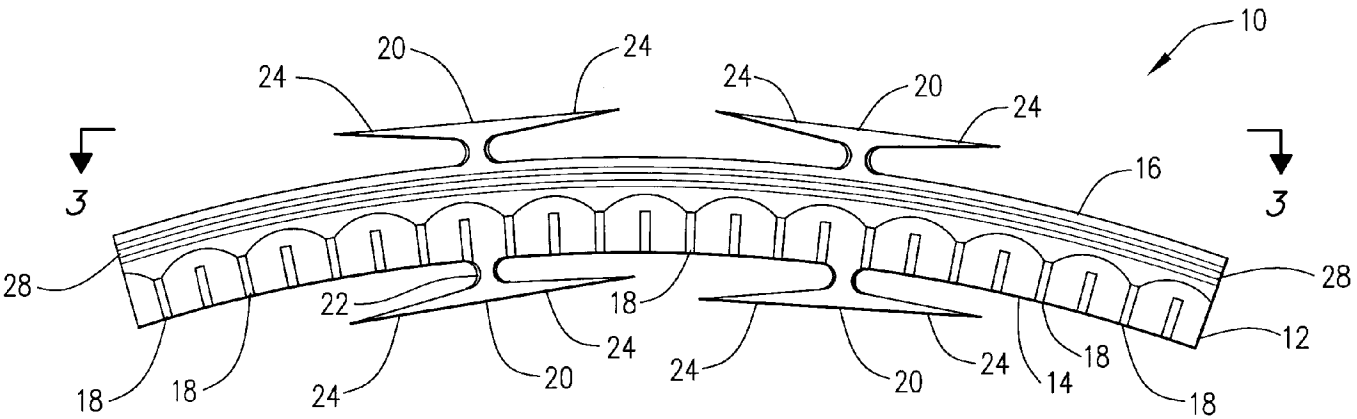
FIG. 2 is a side elevational view of a section of a helical coil of the barbed tape of the present invention.
Figure 3:
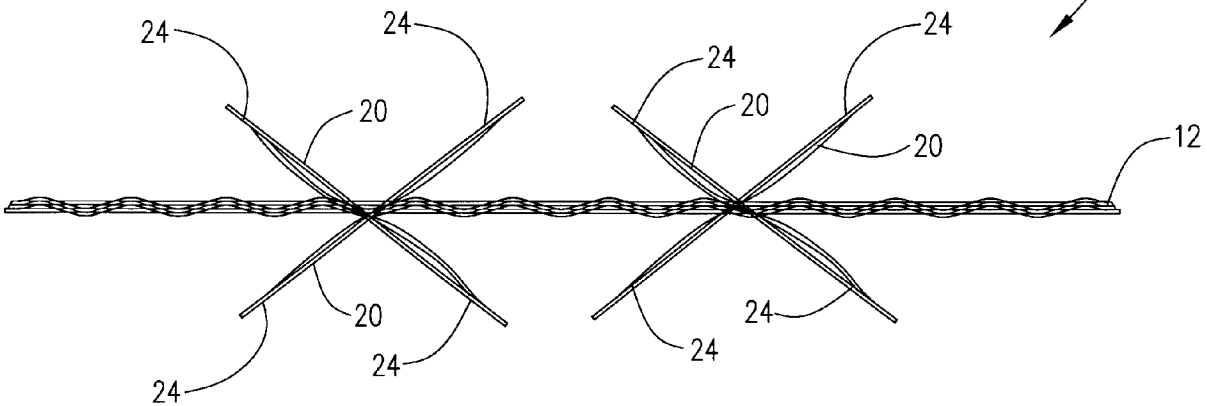
FIG. 3 is a top plan view of the section of the barbed tape shown in FIG. 3.

The barbed tape 10 further comprises a plurality of sharpened barbs 20 which project from at least one, and preferably each of the sides 14 and 16 of the strip 12. Preferably the barbs 20 are formed in clusters, with each cluster having two barbs 20, and with pairs of barbs 20 situated in immediately opposed relation on opposite sides of the strip 12, as shown in FIGS. 1 and 2. Each barb 20 is preferably characterized by a root 22, which joins the barb 20 to the first or second side of the strip 12, and by one or more sharpened spear elements 24 disposed is spaced relationship to the adjacent side of the strip 12. Preferably two spear elements 24 are provided for each barb 20, extending from opposite sides of the root 22. The spear elements 24 may be disposed either in coplanar or angled relationship to the unindented surface of the strip 12, when the strip 12 disposed in a flat configuration. If the spear elements 24 are angled, a preferred angle of barb orientation is between about 5 degrees and about 10 degrees.

A preferred length for each spear element 24 is 1.2 inches. Each of spear element 24 preferably is characterized by a tip radius no greater 0.005 inches. The longitudinal spacing between adjacent clusters of barbs 20 is preferably about 4 inches. Within any given barb 20, the tip-to-tip longitudinal spacing of the paired spear elements 24 on the same side of strip 12 is about 2.4 inches. The tip-to-tip lateral spacing between the corresponding spear elements 24 of adjacent barbs 20 of the same cluster, disposed on opposite sides of the strip 12, is about 1.6 inches. Preferably between about 10 and about 12, and more preferably about 11 corrugations 18 are formed within that portion of the strip 12 situated between two adjacent pairs of barbs 20 disposed in different clusters.

The barbed tape 10 of the present invention is preferably formed by use of punches or dies to blank a flat sheet of steel, to produce an elongate flat tape having barbs formed thereon. A plurality of flat tapes may be formed by blanking different regions of a single sheet of steel. Prior to fabrication, the region of the sheet from which each tape is pinched should have a width of 1.25 inches. Once each flat tape has been formed, roll forming equipment is used to shape the tape's crowned profile and form the strengthening rib 28. The configuration of the tape at the completion of this stage of the manufacturing process is shown in FIG. 1. The spear elements are then bent to angled positions, and rotating spur gears are used to form closely spaced corrugations in the tape.

Formation of the corrugations 18 adjacent the first side 14 of the strip 12 gives the first side 14 an effective length that is shorter than that of the second side 16. As shown in FIGS. 2, 4 and 5, this difference in lateral length causes the barbed tape 10 to form a helical coil 26 about a longitudinal axis. In its coiled configuration, the strip 12 assumes an edgewise orientation, such that the plane of the unindented surface of the strip 12 is disposed in transverse relationship to the longitudinal axis of the coil. One barb 20 of each barb cluster is situated on the outer side of the coil 26. The side of the strip 12 in which corrugations 18 are formed is disposed on the interior of the coil 26.

The loops of the coil 26 are preferably characterized by a circular profile. Preferably, 101 loops are provided for each coil 26. Preferred diameters for the coil 26 are 24 inches, 30 inches, 40 inches, and 60 inches, plus or minus about 1 inch. The number of barb clusters provided for each loop are 19 for a coil having 24 inch diameter, 24 for a coil having 30 inches diameter, 31 for a coil having 40 inch diameter, and 47 for a coil having a 60 inch diameter. This placement assures that barb clusters in adjacent loops will occupy the same angularly positions on the coil.

The barbed tape 10 is well adapted to accurately and easily roll the tape 10 into a tightly packed, compact helical coil, as may be desirable for storage or shipping. In particular, the barbed tape 10 of the present invention is well suited to form coils of smaller diameter, such as 24 and 30 inches. With other barbed tape designs, coils having these smaller diameters are difficult to form. When in use, the tape 10 may be extended from a tightly coiled to a more loosely coiled concertina configuration, and installed on a fence, wall, or other barrier.

A preferred length for a coil 26 disposed in a concertina configuration is between about 49 feet and about 51 feet, and more preferably about 50 feet. The coil 26 is preferably maintained in a loosely coiled concertina configuration by spot welding each loop of the coil 26 to a supporting structure (not shown). One preferred supporting structure is a jacketed stainless steel wire rope. Spacing between adjacent welding attachment points is preferably between about 10 inches and 14 inches, and more preferably about 12 inches. Thus configured, the barbed tape 10 is well-adapted to serve both as a permanent or temporary barrier and entanglement system, as well as an effective deterrent to intrusion.

Changes may be made in the construction, operation and arrangement of the various parts, elements, steps and procedures described herein without departing from the spirit and scope of the invention as defined in the following claims.

The invention claimed is:

1. A barbed tape comprising:

an elongate strip having laterally adjacent corrugated and uncorrugated regions extending along the entire length of the strip, each corrugated region having a profile of transverse ridges and grooves that extend above and below a profile of the adjacent uncorrugated region; and each uncorrugated region having a longitudinally extending strengthening rib;

a series of sharpened barb clusters projecting from at least one side of the strip; wherein the corrugated region is characterized by a plurality of corrugations between each adjacent pair of barb clusters.

2. The barbed tape of claim 1 in which the strip is characterized by laterally spaced first and second sides, and in which the corrugated region extends to and contacts the first side.

3. The barbed tape of claim 2 in which the strip is further characterized by the longitudinally extending strengthening rib being formed adjacent the second side.

4. The barbed tape of claim 1 in which the strip is characterized by a longitudinal centerline, and in which the corrugated extends to the centerline.

5. The barbed tape of claim 1 in which a series of sharpened barbs projects from each side of the strip.

6. The barbed tape of claim 1 in which the strip is unperforated.

7. A coil of the barbed tape defined in claim 1, the coil having a diameter of 24 inches.

8. A coil of the barbed tape defined in claim 1, the coil having a diameter of 30 inches.

* * * * *